US008901829B2

(12) United States Patent
van de Ven et al.

(10) Patent No.: US 8,901,829 B2
(45) **Date of Patent: *Dec. 2, 2014**

(54) SOLID STATE LIGHTING APPARATUS WITH CONFIGURABLE SHUNTS

(75) Inventors: Antony P. van de Ven, Sai Kung (HK); Gerald H. Negley, Chapel Hill, NC (US)

(73) Assignee: Cree LED Lighting Solutions, Inc., Durham, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/566,142

(22) Filed: Sep. 24, 2009

(65) Prior Publication Data

US 2011/0068696 A1 Mar. 24, 2011

(51) Int. Cl.
*H05B 37/02* (2006.01)
*H05B 33/08* (2006.01)

(52) U.S. Cl.
CPC ..... *H05B 33/089* (2013.01); *H05B 33/0872* (2013.01); *H05B 33/083* (2013.01)
USPC ..... 315/185 R; 315/152; 315/291

(58) Field of Classification Search
CPC ..... H05B 37/00; H05B 37/02
USPC ..... 315/122, 200 A, 185 S, 185 R, 164, 312; 362/234, 249.16
See application file for complete search history.

(56) References Cited

U.S. PATENT DOCUMENTS

| | | | |
|---|---|---|---|
| D188,916 | S | 9/1960 | Harling, Donald W. |
| D207,867 | S | 6/1967 | Pettengill |
| 4,504,776 | A | 3/1985 | Haville |
| 4,798,983 | A | 1/1989 | Mori |
| 4,839,535 | A | 6/1989 | Miller |
| 5,059,890 | A | 10/1991 | Yoshikawa et al. |
| 5,397,938 | A | 3/1995 | Wilhelm et al. |
| 5,504,448 | A | 4/1996 | Bennett et al. |
| 5,528,467 | A | 6/1996 | Jiang |
| 5,598,068 | A | 1/1997 | Shirai |
| D384,430 | S | 9/1997 | Lecluze |

(Continued)

FOREIGN PATENT DOCUMENTS

| | | | |
|---|---|---|---|
| CN | 1575623 | A | 2/2005 |
| CN | 101137261 | A | 3/2008 |

(Continued)

OTHER PUBLICATIONS

Notification of Transmittal of the International Search Report and the Written Opinion of the International Searching Authority, or the Declaration; International Search Report; Written Opinion of the International Searching Authority; Corresponding to International Application No. PCT/US2010/048225; 11 pages.

(Continued)

*Primary Examiner* — Tung X Le
*Assistant Examiner* — Jonathan Cooper
(74) *Attorney, Agent, or Firm* — Myers Bigel Sibley & Sajovec, P.A.

(57) ABSTRACT

A solid state lighting apparatus according to some embodiments includes a circuit including a plurality of light emitting devices, and a configurable shunt configured to bypass at least some current around at least one light emitting device of the plurality of light emitting devices. The configurable shunt may include, for example, a tunable resistor, a fuse, a switch, a thermistor, and/or a variable resistor.

28 Claims, 8 Drawing Sheets

(56) References Cited

U.S. PATENT DOCUMENTS

| | | | | |
|---|---|---|---|---|
| 5,803,579 | A | 9/1998 | Turnbull et al. | |
| D400,280 | S | 10/1998 | Leen | |
| D418,620 | S | 1/2000 | Grossman | |
| D425,024 | S | 5/2000 | Klaus et al. | |
| 6,079,852 | A | 6/2000 | Kamaya et al. | |
| 6,153,980 | A * | 11/2000 | Marshall et al. | 315/200 A |
| D437,439 | S | 2/2001 | Tang | |
| 6,201,353 | B1 | 3/2001 | Chang et al. | |
| 6,264,354 | B1 | 7/2001 | Motilal | |
| 6,323,597 | B1 * | 11/2001 | Janning | 315/185 S |
| 6,329,764 | B1 | 12/2001 | van de Ven | |
| 6,556,067 | B2 | 4/2003 | Henry | |
| 6,630,801 | B2 | 10/2003 | Schuurmans | |
| 6,755,550 | B1 | 6/2004 | Lackey | |
| 6,784,622 | B2 | 8/2004 | Newman, Jr. et al. | |
| 6,791,840 | B2 | 9/2004 | Chun | |
| 7,014,341 | B2 | 3/2006 | King et al. | |
| 7,081,722 | B1 | 7/2006 | Huynh et al. | |
| 7,088,059 | B2 | 8/2006 | McKinney et al. | |
| 7,108,238 | B2 | 9/2006 | Gauci | |
| 7,144,140 | B2 | 12/2006 | Sun et al. | |
| 7,213,940 | B1 | 5/2007 | Van De Ven et al. | |
| 7,226,189 | B2 | 6/2007 | Lee et al. | |
| D557,853 | S | 12/2007 | Sandell | |
| D558,374 | S | 12/2007 | Sandell | |
| 7,307,391 | B2 | 12/2007 | Shan | |
| 7,408,308 | B2 | 8/2008 | Sawada et al. | |
| D576,964 | S | 9/2008 | Shaner | |
| 7,427,838 | B2 | 9/2008 | Hosoya | |
| 7,458,706 | B1 | 12/2008 | Liu et al. | |
| 7,513,639 | B2 | 4/2009 | Wang | |
| 7,535,180 | B2 | 5/2009 | Negley et al. | |
| 7,566,154 | B2 | 7/2009 | Gloisten et al. | |
| 7,614,767 | B2 | 11/2009 | Zulim et al. | |
| 7,614,769 | B2 | 11/2009 | Sell | |
| 7,628,513 | B2 | 12/2009 | Chiu | |
| 7,637,635 | B2 | 12/2009 | Xiao et al. | |
| D610,291 | S | 2/2010 | Yoshinobu et al. | |
| 7,656,371 | B2 | 2/2010 | Shimizu et al. | |
| 7,677,767 | B2 | 3/2010 | Chyn | |
| D618,376 | S | 6/2010 | Redfern et al. | |
| 7,758,223 | B2 | 7/2010 | Osawa et al. | |
| 7,780,318 | B2 | 8/2010 | Xiao et al. | |
| D625,038 | S | 10/2010 | Yoo | |
| D627,502 | S | 11/2010 | Zheng et al. | |
| D627,911 | S | 11/2010 | Mo et al. | |
| 7,824,075 | B2 | 11/2010 | Maxik | |
| 7,862,201 | B2 | 1/2011 | Ge et al. | |
| 7,871,184 | B2 | 1/2011 | Peng | |
| 7,914,902 | B2 | 3/2011 | Kao et al. | |
| D636,922 | S | 4/2011 | Yoshida et al. | |
| 7,994,725 | B2 | 8/2011 | Bouchard | |
| D646,011 | S | 9/2011 | Rashida | |
| 8,157,422 | B2 | 4/2012 | Paik et al. | |
| 8,235,555 | B2 | 8/2012 | Thomas et al. | |
| 8,246,202 | B2 | 8/2012 | Mart et al. | |
| 2002/0097095 | A1 | 7/2002 | Jeon et al. | |
| 2004/0036418 | A1 | 2/2004 | Rooke et al. | |
| 2004/0233145 | A1 | 11/2004 | Chiang | |
| 2005/0007164 | A1 | 1/2005 | Callahan, Jr. | |
| 2005/0057179 | A1 | 3/2005 | Madhani et al. | |
| 2005/0111222 | A1 | 5/2005 | Olsson et al. | |
| 2005/0128752 | A1 | 6/2005 | Ewington et al. | |
| 2005/0169015 | A1 | 8/2005 | Luk et al. | |
| 2005/0174065 | A1 * | 8/2005 | Janning | 315/185 S |
| 2005/0242742 | A1 * | 11/2005 | Cheang et al. | 315/149 |
| 2005/0254234 | A1 * | 11/2005 | Wang | 362/184 |
| 2006/0060882 | A1 * | 3/2006 | Ohe et al. | 257/100 |
| 2006/0153511 | A1 * | 7/2006 | Franklin et al. | 385/123 |
| 2006/0244396 | A1 | 11/2006 | Bucur | |
| 2007/0018594 | A1 * | 1/2007 | Janning | 315/312 |
| 2007/0096661 | A1 | 5/2007 | Allen | |
| 2007/0108843 | A1 | 5/2007 | Preston et al. | |
| 2007/0195023 | A1 | 8/2007 | Kang et al. | |
| 2007/0257623 | A1 | 11/2007 | Johnson et al. | |
| 2007/0278974 | A1 | 12/2007 | van de Ven | |
| 2008/0024071 | A1 | 1/2008 | Yu | |
| 2008/0084701 | A1 | 4/2008 | Van De Ven et al. | |
| 2008/0089071 | A1 | 4/2008 | Wang | |
| 2008/0094000 | A1 | 4/2008 | Yamamoto et al. | |
| 2008/0122376 | A1 | 5/2008 | Lys | |
| 2008/0150440 | A1 | 6/2008 | Hsu | |
| 2008/0157688 | A1 * | 7/2008 | Gibboney | 315/185 S |
| 2008/0186704 | A1 | 8/2008 | Chou et al. | |
| 2008/0203946 | A1 | 8/2008 | Ito et al. | |
| 2008/0211415 | A1 | 9/2008 | Altamura | |
| 2008/0309255 | A1 | 12/2008 | Myers et al. | |
| 2009/0015759 | A1 | 1/2009 | Honbo | |
| 2009/0034283 | A1 | 2/2009 | Albright et al. | |
| 2009/0039791 | A1 | 2/2009 | Jones | |
| 2009/0046464 | A1 | 2/2009 | Liu et al. | |
| 2009/0086474 | A1 | 4/2009 | Chou | |
| 2009/0140630 | A1 | 6/2009 | Kijima et al. | |
| 2009/0147517 | A1 | 6/2009 | Li et al. | |
| 2009/0160363 | A1 | 6/2009 | Negley et al. | |
| 2009/0195168 | A1 | 8/2009 | Greenfield | |
| 2010/0060175 | A1 * | 3/2010 | Lethellier | 315/164 |
| 2010/0072902 | A1 | 3/2010 | Wendt et al. | |
| 2010/0079262 | A1 | 4/2010 | Van Laanen | |
| 2010/0090604 | A1 | 4/2010 | Maruyama et al. | |
| 2010/0109570 | A1 | 5/2010 | Weaver | |
| 2010/0123403 | A1 | 5/2010 | Reed | |
| 2010/0134018 | A1 | 6/2010 | Tziony et al. | |
| 2010/0194274 | A1 | 8/2010 | Hoogzaad | |
| 2010/0246197 | A1 | 9/2010 | Takahashi et al. | |
| 2010/0277084 | A1 | 11/2010 | Lee et al. | |
| 2010/0308738 | A1 | 12/2010 | Shteynberg et al. | |
| 2010/0308739 | A1 * | 12/2010 | Shteynberg et al. | 315/193 |
| 2010/0327746 | A1 | 12/2010 | Hisayasu | |
| 2011/0025217 | A1 | 2/2011 | Zhan et al. | |
| 2011/0074265 | A1 | 3/2011 | Van De Ven et al. | |
| 2011/0075411 | A1 | 3/2011 | Van De Ven et al. | |
| 2011/0075414 | A1 | 3/2011 | Van De Ven et al. | |
| 2011/0109228 | A1 | 5/2011 | Shimomura et al. | |
| 2011/0169417 | A1 | 7/2011 | Hum et al. | |
| 2011/0180818 | A1 | 7/2011 | Lerman et al. | |
| 2011/0181194 | A1 | 7/2011 | Hum et al. | |
| 2012/0176826 | A1 | 7/2012 | Lazar | |
| 2012/0194073 | A1 | 8/2012 | Wang et al. | |
| 2013/0278157 | A1 | 10/2013 | Radermacher | |

FOREIGN PATENT DOCUMENTS

| | | | |
|---|---|---|---|
| EP | 1 594 348 | A2 | 11/2005 |
| JP | 2005-310997 | A | 11/2005 |
| JP | 2010527459 | A | 12/2005 |
| JP | 2006-103404 | A | 4/2006 |
| JP | 2006-332022 | A | 12/2006 |
| JP | 2008125339 | A | 5/2008 |
| JP | 2008205357 | A | 9/2008 |
| JP | 2008544569 | A | 12/2008 |
| JP | 2009016280 | A | 1/2009 |
| JP | 2010-092776 | A | 4/2010 |
| TW | 200705714 | | 2/2007 |
| WO | WO 2007/023454 | A1 | 3/2007 |
| WO | WO 2008/051957 | A2 | 5/2008 |
| WO | WO 2008/129504 | | 10/2008 |

OTHER PUBLICATIONS

International Search Report Corresponding to International Application No. PCT/US2011/033736; Date of Mailing: Jul. 7, 2011; 10 Pages.

International Preliminary Report Corresponding to International Application No. PCT/US2011/033736; Date of Mailing: Nov. 22, 2012; 8 Pages.

International Search Report Corresponding to International Application No. PCT/US12/54888; Date of Mailing: Nov. 23, 2012; 12 Pages.

International Search Report Corresponding to International Application No. PCT/US12/54869; Date of Mailing: Nov. 23, 2012; 10 Pages.

(56) References Cited

OTHER PUBLICATIONS

International Preliminary Report on Patentability Corresponding to International Application No. PCT/US2011/038995; Date of Mailing: Dec. 20, 2012; 7 Pages.
Japanese Office Action Corresponding to Japanese Patent Application No. 2012-530920; Date Mailed: Jun. 12, 2013; Foreign Text, 3 Pages, English Translation Thereof, 2 Pages.
Japanese Office Action Corresponding to Japanese Patent Application No. 2013-509109; Date Mailed: Sep. 17, 2013; Foreign Text, 1 Page, English Translation Thereof, 3 Pages.
European Search Report corresponding to European Application No. 11777867.0; Date of Mailing: May 13, 2014; 7 pages.
International Preliminary Report on Patentability Corresponding to International Application No. PCT/US2012/054888; Date of Mailing: Mar. 27, 2014; 10 Pages.
International Preliminary Report on Patentability Corresponding to International Application No. PCT/US2012/054869; Date of Mailing: Mar. 27, 2014; 8 Pages.
European Search Report corresponding to European Application No. 10819249.3; Date of Mailing: Mar. 27, 2014; 8 pages.
International Preliminary Report on Patentability Corresponding to International Application No. PCT/US2010/048225; Date of Mailing: Feb. 27, 2014; 9 Pages.
Chinese Office Action issued for Application No. 201180022813.5; Date of Mailing: Feb. 25, 2014; Translation 5 pages; Non-English Office Action 16 pages.
Chinese Office Action issued for Application No. 201080053889.X; Date of Mailing: Apr. 4, 2014; Translation of Office Action and Search Report 16 pages; Non-English Office Action 46 pages.
Japanese Office Action issued for Application No. 2012-530920; Date of Mailing: May 28, 2014; Translation 2 pages; Non-English Office Action 3 pages.

* cited by examiner

SOLID STATE LIGHTING APPARATUS WITH CONFIGURABLE SHUNTS

RELATED APPLICATIONS

The present invention is related to commonly-assigned U.S. patent application Ser. No. 12/566,195 entitled "Solid State Lighting Apparatus With Controllable Bypass Circuits And Methods Of Operation Thereof,", the disclosure of which is incorporated herein by reference, and which was filed concurrently herewith.

FIELD OF THE INVENTION

The present invention relates to solid state lighting, and more particularly to lighting fixtures including solid state lighting components.

BACKGROUND

Solid state lighting arrays are used for a number of lighting applications. For example, solid state lighting panels including arrays of solid state light emitting devices have been used as direct illumination sources, for example, in architectural and/or accent lighting. A solid state light emitting device may include, for example, a packaged light emitting device including one or more light emitting diodes (LEDs). Inorganic LEDs typically include semiconductor layers forming p-n junctions. Organic LEDs (OLEDs), which include organic light emission layers, are another type of solid state light emitting device. Typically, a solid state light emitting device generates light through the recombination of electronic carriers, i.e. electrons and holes, in a light emitting layer or region.

Solid state lighting panels are commonly used as backlights for small liquid crystal display (LCD) screens, such as LCD display screens used in portable electronic devices. In addition, there has been increased interest in the use of solid state lighting panels as backlights for larger displays, such as LCD television displays.

For smaller LCD screens, backlight assemblies typically employ white LED lighting devices that include a blue-emitting LED coated with a wavelength conversion phosphor that converts some of the blue light emitted by the LED into yellow light. The resulting light, which is a combination of blue light and yellow light, may appear white to an observer. However, while light generated by such an arrangement may appear white, objects illuminated by such light may not appear to have a natural coloring, because of the limited spectrum of the light. For example, because the light may have little energy in the red portion of the visible spectrum, red colors in an object may not be illuminated well by such light. As a result, the object may appear to have an unnatural coloring when viewed under such a light source.

The color rendering index (CRI) of a light source is an objective measure of the ability of the light generated by the source to accurately illuminate a broad range of colors. The color rendering index ranges from essentially zero for monochromatic sources to nearly 100 for incandescent sources. Light generated from a phosphor-based solid state light source may have a relatively low color rendering index.

For large-scale backlight and illumination applications, it is often desirable to provide a lighting source that generates a white light having a high color rendering index, so that objects and/or display screens illuminated by the lighting panel may appear more natural. Accordingly, to improve CRI, red light may be added to the white light, for example, by adding red emitting phosphor and/or red emitting devices to the apparatus. Other lighting sources may include red, green and blue light emitting devices. When red, green and blue light emitting devices are energized simultaneously, the resulting combined light may appear white, or nearly white, depending on the relative intensities of the red, green and blue sources.

SUMMARY

A solid state lighting apparatus according to some embodiments includes a circuit including a plurality of light emitting devices, and a configurable shunt configured to bypass at least some current around at least one light emitting device of the plurality of light emitting devices. The configurable shunt may include, for example, a tunable resistor, a fuse, a switch, a thermistor, and/or a variable resistor.

A solid state lighting apparatus according to further embodiments includes a string of series-connected solid state light emitting devices. The string includes an anode terminal at a first end of the string and a cathode terminal at a second end of the string. At least one configurable shunt is provided between a contact of one of the solid state light emitting devices and the cathode or anode terminal of the string. The configurable shunt electrically bypasses at least one of the solid state light emitting devices when a voltage is applied across the anode and cathode terminals of the string.

Each of the solid state lighting devices includes an anode contact and a cathode contact. The anode contact of each of the solid state light emitting devices may be coupled to the cathode contact of an adjacent solid state light emitting device in the string or to the anode terminal of the string, and the cathode contact of each of the solid state light emitting devices may be coupled to the anode contact of an adjacent solid state light emitting device in the string or to the cathode terminal of the string.

The switch may include an electrically controllable switch, and the solid state lighting apparatus may further include a control circuit coupled to the switch and configured to electrically control an ON/OFF state of the switch.

The solid state lighting apparatus may further include an interface coupled to the control circuit and configured to receive an external input and responsively provide a switch command to the control circuit, and the control circuit may be configured to control the ON/OFF state of the switch in response to the switch command.

The solid state lighting apparatus may further include a plurality of configurable shunts coupled between anode contacts of respective ones of the solid state light emitting devices and the cathode terminal of the string. The solid state light emitting devices may include respective groups of series-connected solid state light emitting devices. The groups of series-connected solid state light emitting devices may be connected in series between the anode contact of the string and the cathode contact of the string, and the configurable shunts may be coupled between anode contacts of first solid state light emitting devices in each of the respective groups and the cathode terminal of the string.

At least two groups of solid state light emitting devices can include different numbers of solid state light emitting devices.

A first group of solid state light emitting devices may be coupled directly to the cathode terminal of the string and may include a first number of solid state light emitting devices, and a second group of solid state light emitting devices may be not coupled directly to the cathode terminal of the string and may include a second number of solid state light emitting devices.

The first number may be not equal to the second number. In some embodiments the first number may be less than the second number, while in other embodiments, the first number may be greater than the second number.

The solid state light emitting apparatus may further include a thermistor coupled in series with the LEDs in the string and/or a thermistor coupled in parallel with the LEDs in the string.

The solid state light emitting apparatus may further include a variable resistor coupled in series and/or a variable resistor coupled in parallel with the LEDs in the string.

The string may include a first string of light emitting diodes configured to emit light having a first chromaticity, and the apparatus may further include a second string of light emitting devices configured to emit light having a second chromaticity, different from the first chromaticity. The first chromaticity and the second chromaticity may be non-white, and light emitted by both the first and second strings may have a combined chromaticity that is white.

The second string of light emitting devices may include a second configurable shunt configured to bypass at least some current in the second string around at least one light emitting device in the second string.

In some embodiments, at least two of the light emitting devices may be connected in parallel, and the configurable shunt may be configured to bypass current around the at least two parallel connected light emitting devices.

Some embodiments provide methods of operating a solid state lighting apparatus including a string of series-connected solid state light emitting devices, each of the solid state light emitting devices including an anode contact and a cathode contact, and the string including an anode terminal at a first end of the string and a cathode terminal at a second end of the string. The methods include passing a reference current through the string, measuring color and/or intensity of light output from the string in response to the reference current, and providing at least one configurable shunt coupled between a contact of one of the solid state light emitting devices and the cathode or anode terminal of the string in response to the measured color and/or intensity of light output from the string. The configurable shunt electrically bypasses at least one of the solid state light emitting devices when a voltage is applied across the anode and cathode terminals of the string.

The string may include a first string of solid state light emitting devices configured to emit light having a dominant wavelength in a first portion of the visible spectrum, and the solid state lighting apparatus may further include a second string of solid state light emitting devices configured to emit light having a dominant wavelength in a second portion of the visible spectrum, different from the first portion. The methods may further include passing a second reference current through the second string, and measuring color and/or intensity of light output may include measuring color and/or intensity of light output from the first string and the second string in response to the reference current and the second reference current.

Providing the configurable shunt may include activating a switch coupled between the contact of the one of the solid state light emitting devices and the cathode or anode terminal of the string.

Providing the configurable shunt may include varying a resistance of a tunable resistor coupled between the contact of the one of the solid state light emitting devices and the cathode or anode terminal of the string.

Other apparatus and/or methods according to embodiments of the invention will be or become apparent to one with skill in the art upon review of the following drawings and detailed description. It is intended that all such additional apparatus and/or methods be included within this description, be within the scope of the present invention, and be protected by the accompanying claims.

BRIEF DESCRIPTION OF THE DRAWINGS

The accompanying drawings, which are included to provide a further understanding of the invention and are incorporated in and constitute a part of this application, illustrate certain embodiment(s) of the invention. In the drawings.

DETAILED DESCRIPTION OF EMBODIMENTS

Figure 1A:
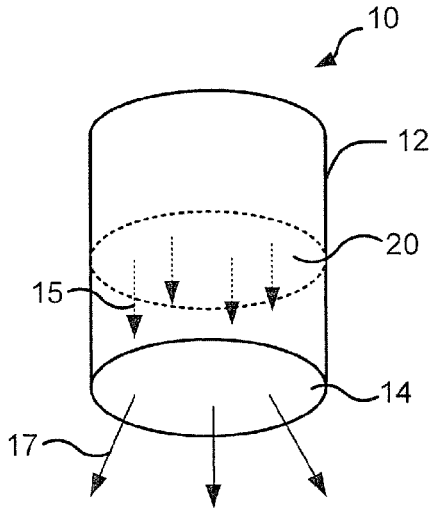
FIGS. 1A and 1B illustrate a solid state lighting apparatus in accordance with some embodiments of the invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Figure 1B:
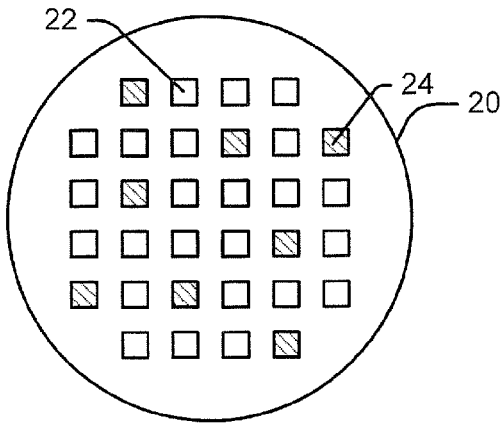

Referring to FIGS. 1A and 1B, a lighting apparatus 10 according to some embodiments is illustrated. The lighting apparatus 10 shown in FIGS. 1A and 1B is a "can" lighting fixture that may be suitable for use in general illumination applications as a down light or spot light. However, it will be appreciated that a lighting apparatus according to some embodiments may have a different form factor. For example, a lighting apparatus according to some embodiments can have the shape of a conventional light bulb, a pan or tray light, an automotive headlamp, or any other suitable form.

The lighting apparatus 10 generally includes a can shaped outer housing 12 in which a lighting panel 20 is arranged. In the embodiments illustrated in FIGS. 1A and 1B, the lighting panel 20 has a generally circular shape so as to fit within an interior of the cylindrical housing 12. Light is generated by solid state lighting devices (LEDs) 22, 24, which are mounted on the lighting panel 20, and which are arranged to emit light 15 towards a diffusing lens 14 mounted at the end of the housing 12. Diffused light 17 is emitted through the lens 14. In some embodiments, the lens 14 may not diffuse the emitted light 15, but may redirect and/or focus the emitted light 15 in a desired near-field or far-field pattern.

Still referring to FIGS. 1A and 1B, the solid-state lighting apparatus 10 may include a plurality of first LEDs 22 and a plurality of second LEDs 24. In some embodiments, the plurality of first LEDs 22 may include white emitting, or near white emitting, light emitting devices. The plurality of second LEDs 24 may include light emitting devices that emit light having a different dominant wavelength from the first LEDs 22, so that combined light emitted by the first LEDs 22 and the second LEDs 24 may have a desired color and/or spectral content.

For example, the combined light emitted by the plurality of first LEDs 22 and the plurality of second LEDs 24 may be warm white light that has a high color rendering Index.

The chromaticity of a particular light source may be referred to as the "color point" of the source. For a white light source, the chromaticity may be referred to as the "white point" of the source. The white point of a white light source may fall along a locus of chromaticity points corresponding to the color of light emitted by a black-body radiator heated to a given temperature. Accordingly, a white point may be identified by a correlated color temperature (CCT) of the light source, which is the temperature at which the heated black-body radiator matches the hue of the light source. White light typically has a CCT of between about 2500K and 8000K. White light with a CCT of 2500K has a reddish color, white light with a CCT of 4000K has a yellowish color, and while light with a CCT of 8000K is bluish in color.

"Warm white" generally refers to white light that has a CCT between about 3000 and 3500° K. In particular, warm white light may have wavelength components in the red region of the spectrum, and may appear yellowish to an observer. Warm white light typically provides a relatively high CRI, and accordingly can cause illuminated objects to have a more natural color. For illumination applications, it is therefore desirable to provide a warm white light.

In order to achieve warm white emission, conventional packaged LEDs include either a single component orange phosphor in combination with a blue LED or a mixture of yellow/green and orange/red phosphors in combination with a blue LED. However, using a single component orange phosphor can result in a low CRI as a result of the absence of greenish and reddish hues. On the other hand, red phosphors are typically much less efficient than yellow phosphors. Therefore, the addition of red phosphor in yellow phosphor can reduce the efficiency of the package, which can result in poor luminous efficacy. Luminous efficacy is a measure of the proportion of the energy supplied to a lamp that is converted into light energy. It is calculated by dividing the lamp's luminous flux, measured in lumens, by the power consumption, measured in watts.

Warm white light can also be generated by combining non-white light with red light as described in U.S. Pat. No. 7,213,940, entitled "LIGHTING DEVICE AND LIGHTING METHOD," which is assigned to the assignee of the present invention, and the disclosure of which is incorporated herein by reference. As described therein, a lighting device may include first and second groups of solid state light emitters, which emit light having dominant wavelength in ranges of from 430 nm to 480 nm and from 600 nm to 630 nm, respectively, and a first group of phosphors which emit light having dominant wavelength in the range of from 555 nm to 585 nm. A combination of light exiting the lighting device which was emitted by the first group of emitters, and light exiting the lighting device which was emitted by the first group of phosphors produces a sub-mixture of light having x, y color coordinates within a defined area on a 1931 CIE Chromaticity Diagram that is referred to herein as "blue-shifted yellow" or "BSY." Such non-white light may, when combined with light having a dominant wavelength from 600 nm to 630 nm, produce warm white light.

Blue and/or green LEDs used in a lighting apparatus according to some embodiments may be InGaN-based blue and/or green LED chips available from Cree, Inc., the assignee of the present invention. Red LEDs used in the lighting apparatus may be, for example, AlInGaP LED chips available from Epistar, Osram and others.

In some embodiments, the LEDs 22, 24 may have a square or rectangular periphery with an edge length of about 900 μm or greater (i.e. so-called "power chips." However, in other embodiments, the LED chips 22, 24 may have an edge length of 500 μm or less (i.e. so-called "small chips"). In particular, small LED chips may operate with better electrical conversion efficiency than power chips. For example, green LED chips with a maximum edge dimension less than 500 microns and as small as 260 microns, commonly have a higher electrical conversion efficiency than 900 micron chips, and are known to typically produce 55 lumens of luminous flux per Watt of dissipated electrical power and as much as 90 lumens of luminous flux per Watt of dissipated electrical power.

The LEDs 22 in the lighting apparatus 10 may include white/BSY emitting LEDs, while the LEDs 24 in the lighting apparatus may emit red light. The LEDs 22, 24 in the lighting apparatus 10 may be electrically interconnected in respective strings, as illustrated in the schematic circuit diagram in FIG. 2. As shown therein, the LEDs 22, 24 may be interconnected such that the white/BSY LEDs 22 are connected in series to form a first string 34A. Likewise, the red LEDs 24 may be arranged in series to form a second string 34B. Each string 32, 34 may be connected to a respective anode terminal 23A, 25A and a cathode terminal 23B, 25B.

Figure 2:
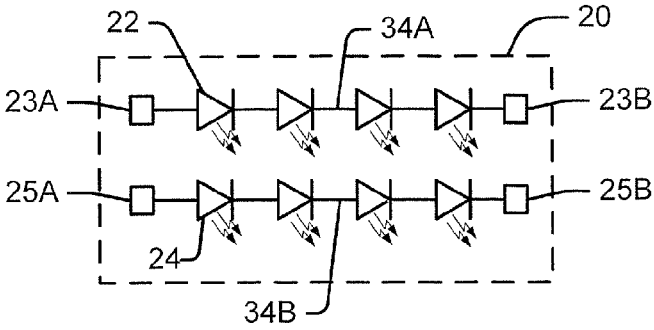
FIG. 2 is a schematic circuit diagram illustrating series interconnection of light emitting devices (LEDs) in a solid state lighting apparatus.

Although two strings 34A, 34B are illustrated in FIG. 2, it will be appreciated that the lighting apparatus 10 may include more or fewer strings. Furthermore, there may be multiple strings of white/BSY LEDs 22, and multiple strings of red or other colored LEDs 24.

Figure 3:
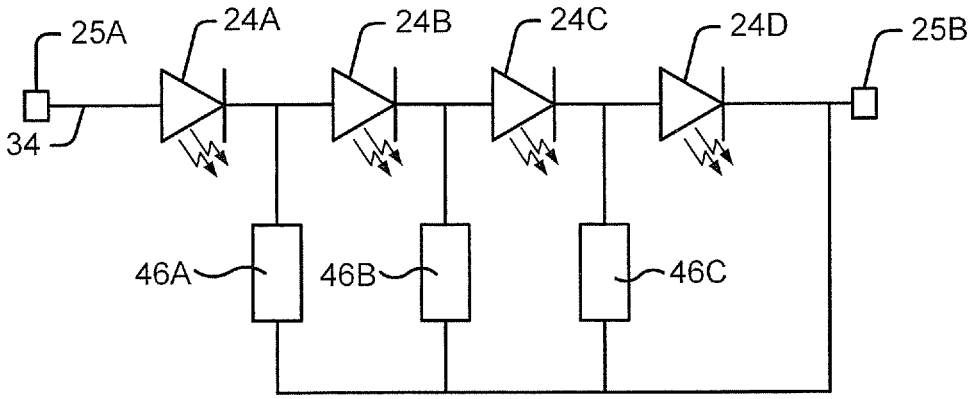
FIGS. 3-6 are schematic circuit diagrams illustrating the electrical interconnection of LEDs in a solid state lighting apparatus in accordance with various embodiments of the invention.

Referring now to FIG. 3, an LED string 34 of a solid state lighting apparatus 10 according to some embodiments is illustrated in more detail. The LED string 34 could correspond to either or both of the strings 34A, 34B illustrated in FIG. 2. The string 34 includes four LEDs 24A-24D connected in series between an anode terminal 25A and a cathode terminal 25B. In the embodiments illustrated in FIG. 3, the string 34 includes four LEDs 24A-24D. However, the string 34 may include more or fewer LEDs.

Each of the solid state LEDs 24A-24C includes an anode contact and a cathode contact. The anode contact of each of the LEDs is coupled to the cathode contact of an adjacent LED in the string or to the anode terminal 25A of the string, and the cathode contact of each of the LEDs is coupled to the anode contact of an adjacent LED in the string or to the cathode terminal 25B of the string.

A plurality of configurable shunts 46A-46C are coupled between an anode contact of a respective one of the LEDs 24B-24D and the cathode terminal 25B of the string 34. Each of the configurable shunts 46A-46C may electrically bypass, for example by short circuiting, one or more of the solid state light emitting devices when a voltage is applied across the anode and cathode terminals 25A, 25B of the string 34.

The configurable shunts 46A-46C may be configured to be conductive or non-conductive. In some embodiments, the conduction state of the configurable shunts 46A-46C may be electrically and/or manually controllable/settable. For example, the configurable shunts 46A-46C may include tunable resistors that can be tuned between a high impedance state and a low impedance state. The tunable resistors may be manually and/or electrically tunable.

In other embodiments, the configurable shunts 46A-46C may be settable to a conductive state or a non-conductive state, and may remain in such a state after being set. For example, the configurable shunts 46A-46C may include fuses, switches, jumpers, etc., that can be set to a conductive or non-conductive state.

Thus, for example, by configuring one of the configurable shunts 46A-46C to be conductive, one or more of the LEDs 24B-24D may be switched out of the string 34, so that the string 34 effectively includes fewer LEDs 24A-24D. The total luminescent power output by the string 34 will thereby be reduced, which means that the color point of mixed light that is a combination of light emitted by the string 34 and another string 32 within the lighting apparatus 10 will be altered. The color point of the lighting apparatus 10 may thereby be adjusted by configuring the conduction state of the configurable shunts 46A-46C of the string 34.

Current through the string 34 may be provided by a constant current source, such as the variable voltage boost current source described in U.S. Publication No. 20070115248, assigned to the assignee of the present invention, and the disclosure of which is incorporated herein by reference. Thus, switching one or more of the LEDs 24A-24D out of the string 34 may not affect the current supplied to the string.

Figure 4:
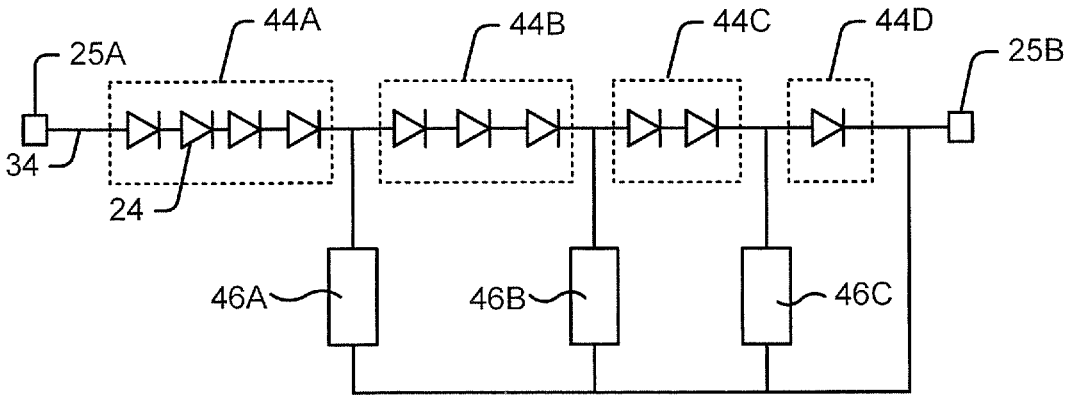
Figure 5:
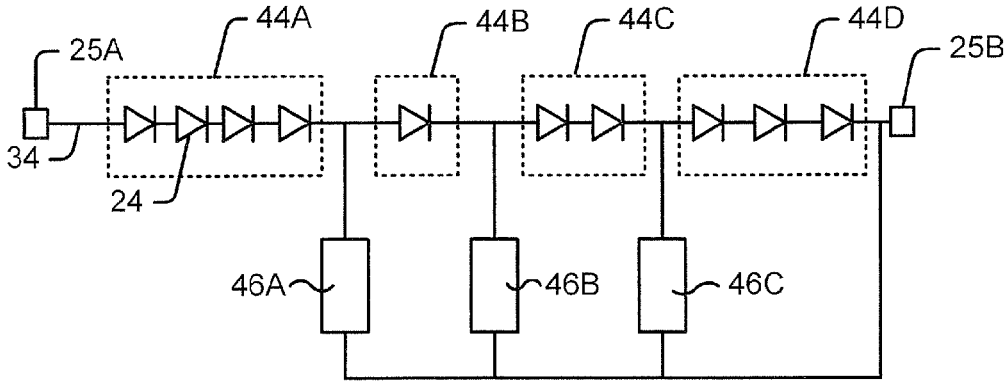

Referring to FIGS. 4-5, the solid state light emitting devices may be arranged into respective groups 44A-44C of series-connected solid state light emitting devices 24. The groups 44A-44C of series-connected solid state light emitting devices are connected in series between the anode contact 25A of the string 34 and the cathode contact 25B of the string 34. The configurable shunts 46A-46C are coupled to cathode contacts of the last solid state light emitting devices in each of the respective groups 44A-44C and to the cathode terminal 25B of the string 34.

As illustrated in FIGS. 4-5, at least two groups 44A-44C include different numbers of solid state light emitting devices 24. For example, in the configuration illustrated in FIG. 4, group 44A includes four LEDs 24, group 44B includes three LEDs, and group 44C includes two LEDs. In the configuration illustrated in FIG. 5, group 44A includes four LEDs 24, group 44B includes one LED, and group 44C includes two LEDs. Accordingly, in the configuration illustrated in FIG. 4, the string 34 may effectively include four, seven, nine or ten LEDs depending on the conduction/nonconduction states of the configurable shunts 46A-46C.

In contrast, in the configuration illustrated in FIG. 5, the string 34 may effectively include four, five, seven or ten LEDs depending on the conduction/nonconduction states of the configurable shunts 46A-46C. Many other configurations are possible according to other embodiments. Accordingly, the number of LEDs in a group 44A-44C and the arrangement of the configurable shunts 46A-46C affects the ability of a system or user to configure the number of LEDs that will actually be energized when a voltage is applied to the anode and cathode terminals 25A, 25B of the string 34.

Figure 6:
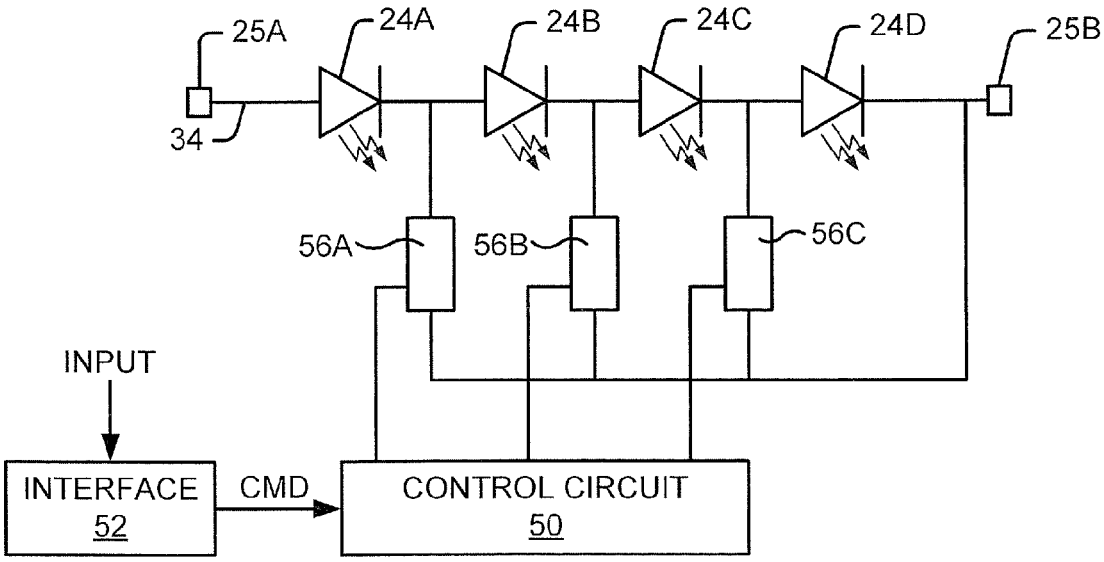

As noted above, a configurable shunt 46A-46C may include a switch coupled between the anode contact of the one of the solid state light emitting devices 24A-24D and the cathode terminal 25B of the string. Referring to FIG. 6, the switch may include an electrically controllable switch 56A-56C, and the solid state lighting apparatus may further include a control circuit 50 coupled to the switches 56A-56C and configured to electrically control an ON/OFF state of the switches 56A-56C.

The solid state lighting apparatus 10 may further include an interface 52 coupled to the control circuit 50 and configured to receive an external input and responsively provide a switch command CMD to the control circuit 50. The control circuit 50 may be configured to control the ON/OFF state of the switches 56A-56C in response to the switch command. The external input may comprise an electronic and/or manual input.

Figure 7A:
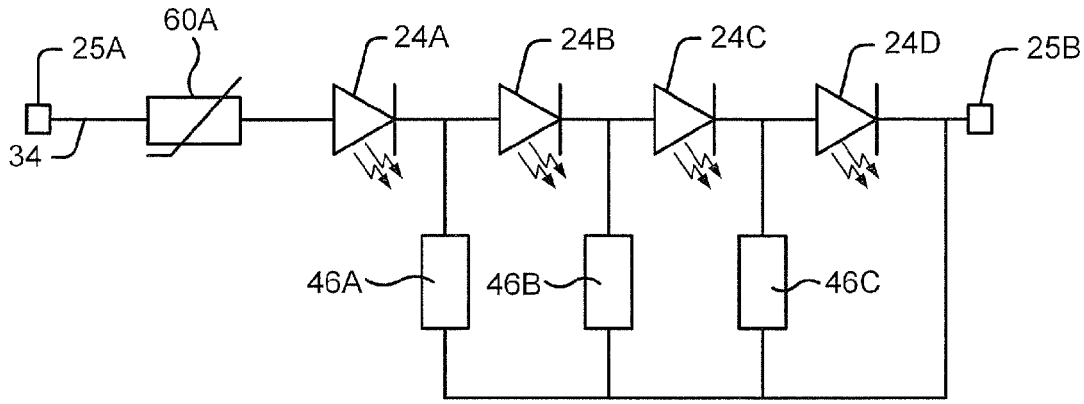
FIGS. 7A and 7B are schematic circuit diagrams illustrating the electrical interconnection of LEDs in a solid state lighting apparatus in accordance with various embodiments of the invention.
Figure 7B:
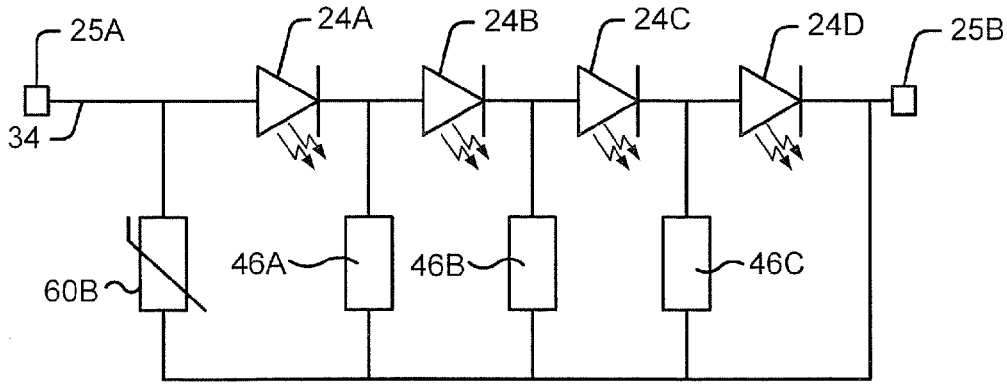
Figure 8:
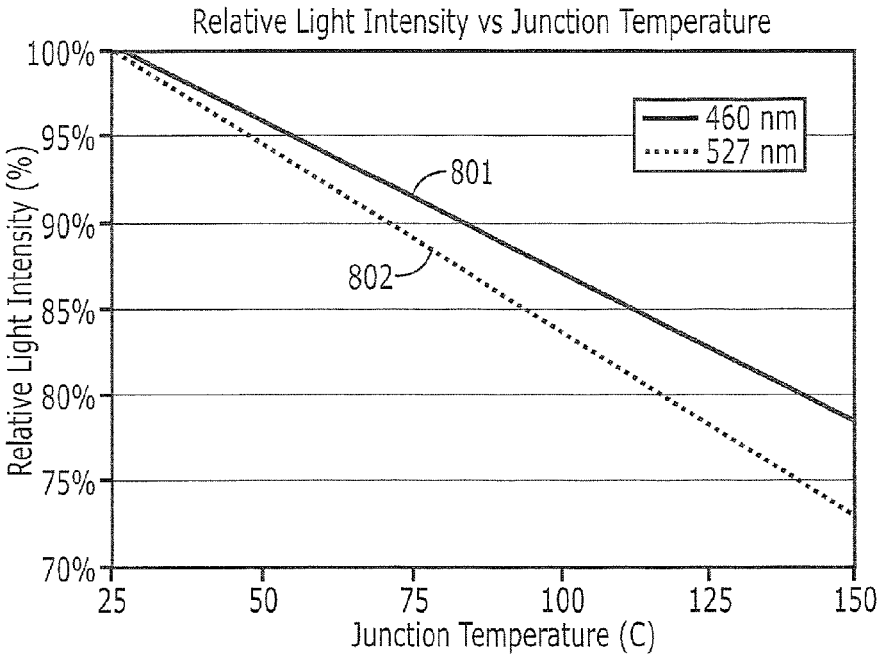
FIG. 8, is a graph of light intensity versus junction temperature for LEDs having emission wavelengths of 460 nm and 527 nm.

Referring to FIGS. 7A and 7B, the solid state light emitting apparatus 10 may further include a thermistor 60A coupled in series with the LEDs 24A-24D (FIG. 7A) and/or a thermistor 60B coupled in parallel (FIG. 7B) with the LEDs 24A-24D in the string 34. The thermistor 60 may be used to compensate for changes in light emission characteristics of the LEDs 24 that occur in response to changes in the junction temperature of the LEDs 24. In particular, it is known that the luminescent output of LEDs may decrease with increased junction temperature, as illustrated in FIG. 8, which is a graph of light intensity versus junction temperature for EZ1000 LEDs manufactured by Cree, Inc., Durham, N.C. having emission wavelengths of 460 nm (curve 801) and 527 nm (curve 802).

Accordingly, the series connected thermistor 60A may have a negative temperature coefficient (i.e., the resistance of the thermistor 60A decreases with increased temperature) while the parallel connected thermistor 60B may have a positive temperature coefficient (resistance increases with increased temperature), so that current passing through LEDs 24 may be increased with increasing temperature to compensate for the reduction in light intensity as the temperature of the devices increases.

Figure 9:
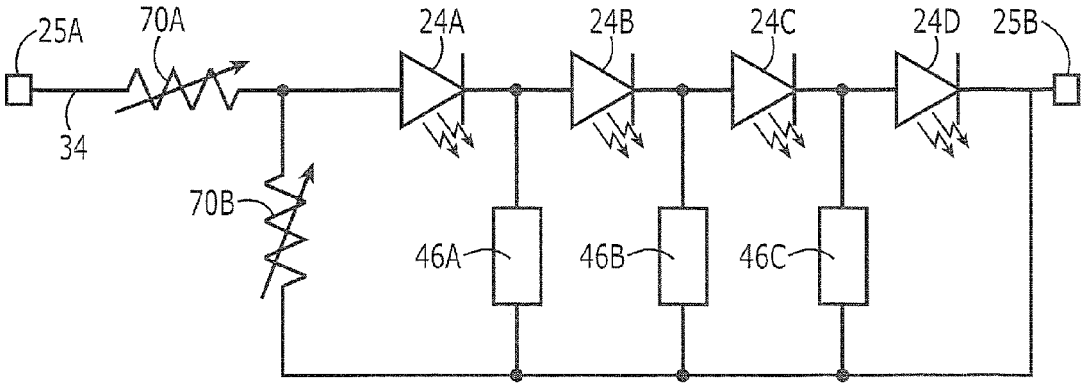
FIG. 9 is a schematic circuit diagram illustrating the electrical interconnection of LEDs in a solid state lighting apparatus in accordance with further embodiments of the invention.

Referring to FIG. 9, the solid state light emitting apparatus may further include a variable resistor 70A coupled in series with the string 34 and/or a variable resistor 70B coupled in parallel with the string 34. The resistances of the variable resistors 70A, 70B can be dynamically altered to compensate for temperature-induced changes in light emission as described above in connection with the thermistors 60A, 60B, and also to compensate for drift in the emission characteristics of the LEDs 24A-24D that can occur over time.

Figure 10:
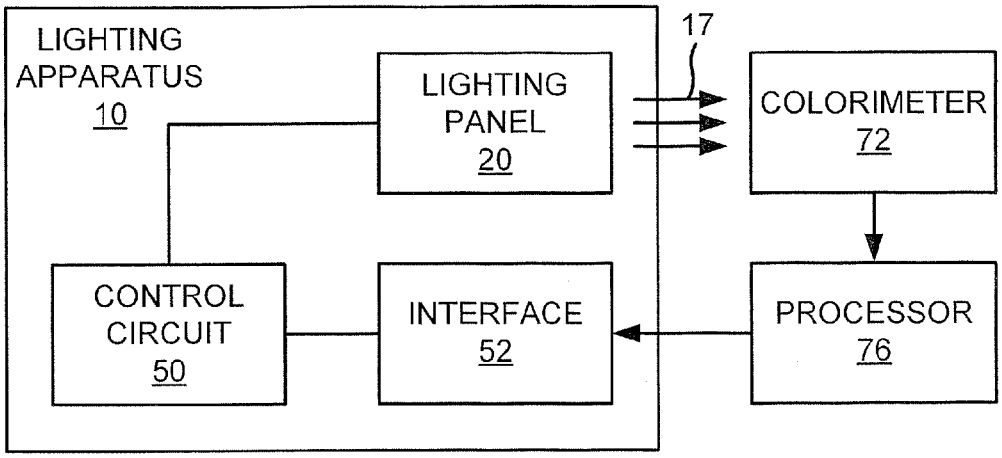
FIG. 10 illustrates systems/methods used to configure the color point of a solid state lighting apparatus according to some embodiments.
Figure 11:
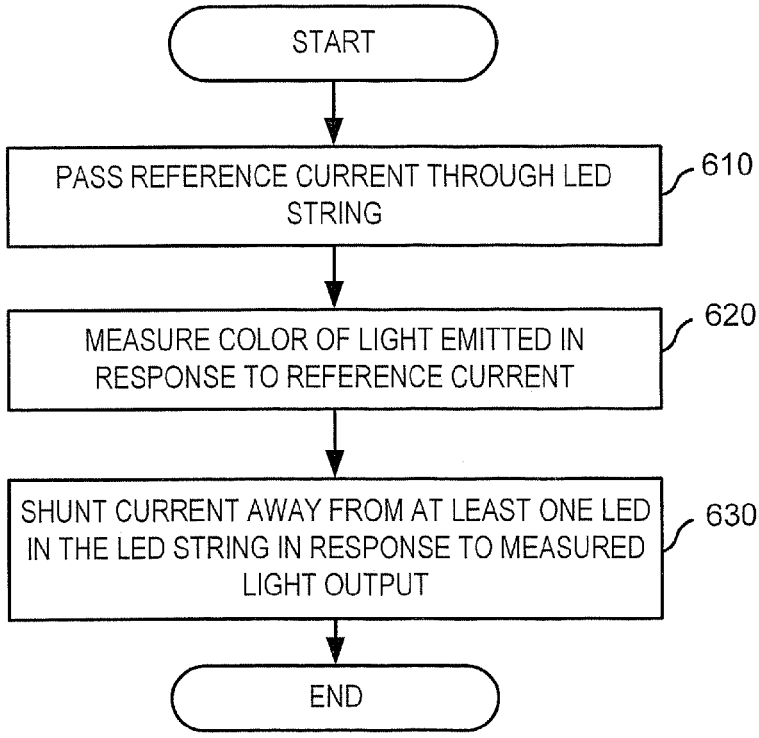
FIG. 11 is a flowchart illustrating operations of configuring the color point of a solid state lighting apparatus according to some embodiments of the invention.

FIGS. 10 and 11 illustrate systems/methods used to calibrate a lighting apparatus 10 according to some embodiments. As shown therein, a lighting apparatus 10 including a lighting panel 20, a control circuit 50 and an interface 52 may be calibrated using a colorimeter 72 and a processor 76. Light 17 generated by the lighting panel 20 is emitted by the lighting apparatus 10 and detected by the colorimeter 72. The colorimeter 72 may be, for example, a PR-650 SpectraScan® Colorimeter from Photo Research Inc., which can be used to make direct measurements of luminance, CIE Chromaticity (1931 xy and 1976 u'v') and/or correlated color temperature. A color point of the light 17 may be detected by the colorimeter 72 and communicated to the processor 76. In response to the detected color point of the light 17, the processor 76 may determine that light output of one or more strings of LEDs in the lighting panel 20 should be altered by switching one or more LEDs, or groups of LEDs out of the string using the configurable shunts. The processor 76 may then issue a command to the control circuit 50 via the interface 52 to set the conductivity of one or more of the configurable shunts, and thereby adjust the color point of the light 17 output by lighting panel 20.

FIG. 11 is a flowchart illustrating operations according to some embodiments for adjusting the light output of a string of series-connected LEDs 24A-24D, such as the string 34 illustrated in FIG. 3. A reference current is passed through the string 34 (Block 610), and color and/or intensity of light output from the string in response to the reference current is measured (Block 620). In response to the measured color and/or intensity of the light output by the string 34, at least one configurable shunt 46A-46C is provided between an anode contact of one of the LEDs 24A-24D and the cathode terminal of the string 34 (Block 630). The configurable shunt 46A-46C electrically bypasses at least one of the LEDs 24A-24D when a voltage is applied across the anode and cathode terminals of the string 34.

Figure 12:
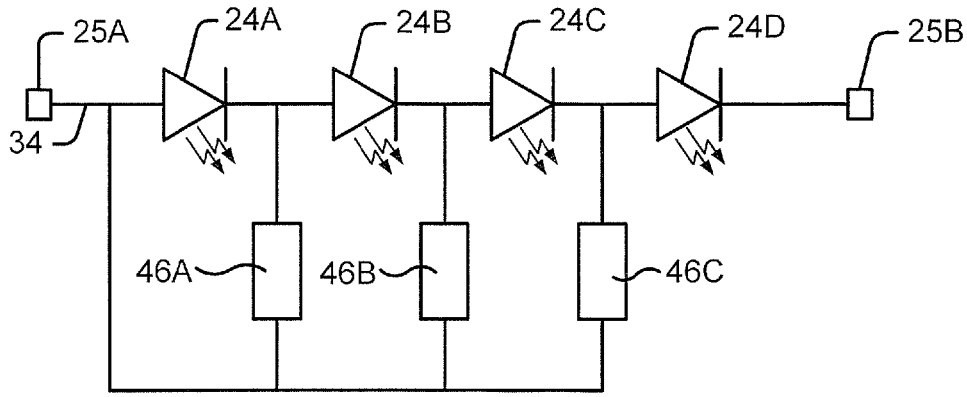
FIGS. 12-15 are schematic circuit diagrams illustrating the electrical interconnection of LEDs in solid state lighting apparatus in accordance with further embodiments of the invention.
Figure 13:
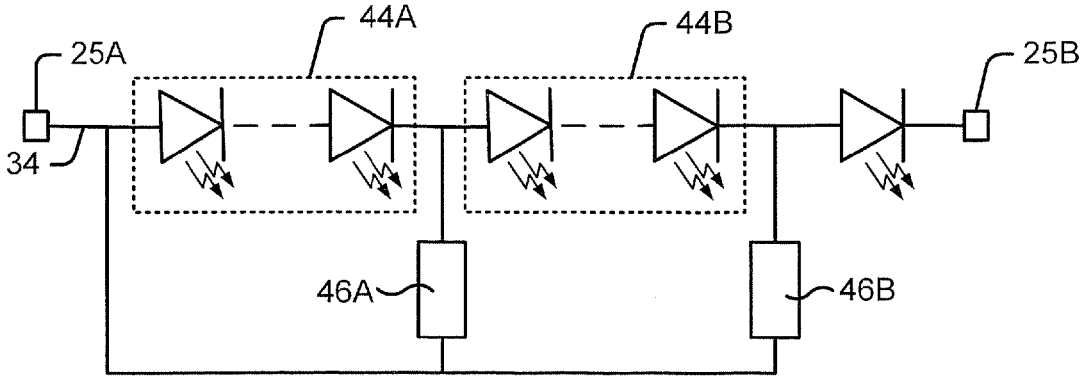
Figure 14:
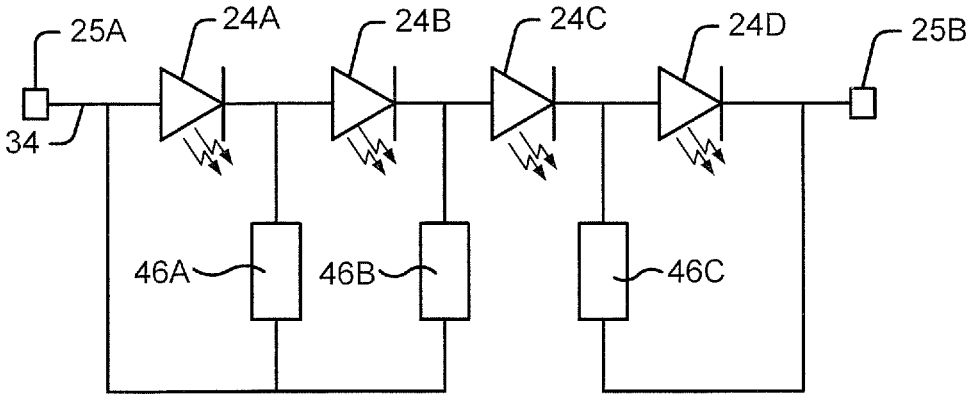

Further embodiments are illustrated in FIGS. 12-15. As shown in FIG. 12, the configurable shunts 46A-46C may be provided between respective cathode contacts of the LEDs 24A-24C and the anode contact 25A of the string 34. Similarly, as shown in FIG. 13, the configurable shunts 46A-46C may be provided between respective cathode contacts of groups 44A-44C of LEDs and the anode contact 25A of the string 34.

In further embodiments, some of the configurable shunts may be provided between anode contacts of some of the LEDs 24A-24D and the cathode contact 25B of the string 34, while others of the configurable shunts may be provided between cathode contacts of some of the LEDs 24A-24D and the anode contact 25A of the string 34. For example, in the embodiments illustrated in FIG. 14, the configurable shunts 46A, 46B are connected between the cathodes of the LEDs 24A, 24B and the anode contact 25A of the string 34, while the configurable shunt 46C is connected between the anode of the LED 24D and the cathode contact 25B of the string 34.

Figure 15:
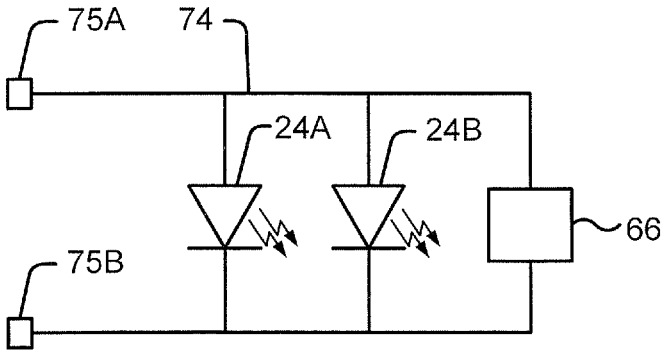

Still further embodiments are illustrated in FIG. 15. As shown therein, a circuit 74 includes light emitting devices 24A, 24B connected in parallel between anode and cathode contacts 75A, 75B. A configurable shunt 66 is connected in parallel with the light emitting devices 24A, 24B. The configurable shunt 66 may include a switch, fuse, thermistor, variable resistor, etc., as described above. The configurable shunt may be configured and/or controlled to alter current flowing through the parallel light emitting devices 24A, 24B.

Some embodiments of the present invention are described above with reference to flowchart illustrations and/or block diagrams of methods, systems and computer program products according to embodiments of the invention. It is to be understood that the functions/acts noted in the blocks may occur out of the order noted in the operational illustrations. For example, two blocks shown in succession may in fact be executed substantially concurrently or the blocks may sometimes be executed in the reverse order, depending upon the functionality/acts involved. Although some of the diagrams include arrows on communication paths to show a primary direction of communication, it is to be understood that communication may occur in the opposite direction to the depicted arrows.

In the drawings and specification, there have been disclosed typical embodiments of the invention and, although specific terms are employed, they are used in a generic and descriptive sense only and not for purposes of limitation, the scope of the invention being set forth in the following claims.

That which is claimed is:

1. A solid state lighting apparatus comprising:

a circuit comprising a plurality of light emitting devices wherein the solid state light emitting devices are connected in series to form a string including an anode terminal at a first end of the string and a cathode terminal at a second end of the string;

a first configurable shunt directly coupled between a terminal of a first light emitting device in the string and at least one of the cathode or anode terminal of the string and configured to bypass at least sonic current around the first light emitting device;

a second configurable shunt directly coupled between a terminal of a second light emitting device and a same end terminal of the string as the first configurable shunt and configured to bypass at least some current around the first light emitting device and the second light emitting device, wherein the second light emitting device emits light of a different color than the first light emitting device; and a thermistor, tunable resistor and/or variable resistor coupled in parallel with the first and second configurable shunts, wherein the thermistor, tunable resistor and/or variable resistor is different than the first and second configurable shunts.

2. The solid state lighting apparatus of claim 1, wherein the first configurable shunt comprises a tunable resistor, a switch, and/or a variable resistor.

3. The solid state lighting apparatus of claim 1, wherein each of the solid state lighting devices includes an anode contact and a cathode contact, the anode contact of each of the solid state light emitting devices is coupled to the cathode contact of an adjacent solid state light emitting device in the string or to the anode terminal of the string, and the cathode contact of each of the solid state light emitting devices is coupled to the anode contact of an adjacent solid state light emitting device in the string or to the cathode terminal of the string.

4. The solid state lighting apparatus of claim 3, wherein the first configurable shunt comprises an electrically controllable switch, the solid state lighting apparatus further comprising a control circuit coupled to the switch and configured to electrically control an ON/OFF state of the switch.

5. The solid state lighting apparatus of claim 4, further comprising an interface coupled to the control circuit and configured to receive an external input and responsively provide a switch command to the control circuit, wherein the control circuit is configured to control the ON/OFF state of the first configurable shunt in response to the switch command.

6. The solid state lighting apparatus of claim 1, wherein the solid state light emitting devices comprise respective groups of series-connected solid state light emitting devices, wherein the groups of series-connected solid state light emitting devices are connected in series between the anode contact of the string and the cathode contact of the string, and wherein the first configurable shunt is coupled between a first group of series-connected solid state light emitting devices and the cathode or anode terminal of the string and is configured to bypass at least some current around the first group of series-connected solid state light emitting devices.

7. The solid state lighting apparatus of claim 6, wherein at least two groups of series-connected solid state light emitting devices comprise different numbers of solid state light emitting devices.

8. The solid state lighting apparatus of claim 7, wherein the first group of series-eonnected solid state light emitting devices is coupled directly to the cathode terminal of the string and includes a first number of solid state light emitting devices, and wherein the second light emitting device comprises a second group of series-connected solid state light emitting devices that is not coupled directly to the cathode terminal of the string and includes a second number of solid state light emitting devices, wherein the first number is not equal to the second number.

9. The solid state lighting apparatus of claim 8, wherein the first number is less than the second number.

10. The solid state lighting apparatus of claim 8, wherein the first number is greater than the second number.

11. The solid state lighting apparatus of claim 1, further comprising a thermistor coupled in series with the string.

12. The solid state lighting apparatus of claim 1, further comprising a variable resistor coupled in series with the string.

13. The solid state lighting apparatus of claim 1, wherein the string comprises a first string of light emitting diodes configured to emit light having a first chromaticity, the apparatus further comprising a second string of light emitting devices configured to emit light having a second chromaticity, different from the first chromaticity.

14. The solid state lighting apparatus of claim 13, wherein the first chromaticity and the second chromaticity are non-white, and wherein light emitted by both the first and second strings has a combined chromaticity that is white.

15. The solid state lighting apparatus of claim 13, wherein the second string of light emitting devices comprises a second configurable shunt configured to bypass at least some current in the second sting around at least one light emitting device in the second string.

16. The solid state lighting apparatus of claim 1, wherein at least two of the light emitting devices are connected in parallel, and the configurable shunt is configured to bypass current around the at least two parallel connected light emitting devices.

17. A method of operating a solid state lighting apparatus including a first string of series-connected solid state light emitting devices configured to emit light having a dominant wavelength in a first portion of the visible spectrum and a second string of solid state light emitting devices configured to emit light having a dominant wavelength in a second portion of the visible spectrum different from the first portion, the first string including an anode terminal at a first end of the first string and a cathode terminal at a second end of the first string, the method comprising;

passing a first reference current through the first string;

passing a second reference current through the second string;

measuring color of light output from the first string and the second string in response to the first reference current and the second reference current;

providing at least two configurable shunts, wherein each of the at least two shunts is directly coupled between a terminal of one of the solid state light emitting devices and the anode or cathode terminal of the first string;

providing a thermistor, tunable resistor and/or variable resistor coupled in parallel with the at least two configurable shunts; and increasing the first reference current to compensate for a reduction in light intensity as the temperature of the first string increases.

18. The method of claim 17, wherein providing the configurable shunt comprises activating a switch coupled between the terminal of a respective one of the solid state light emitting devices and the anode or cathode terminal of the first string.

19. The method of claim 17, wherein providing the configurable shunt comprises varying a resistance of a tunable resistor coupled between the terminal of a respective one of the solid state light emitting devices and the anode or cathode terminal of the first string.

20. The solid state lighting apparatus of claim 1, further comprising a second configurable shunt coupled between a contact of a second light emitting device in the string and the same end terminal of the string and configured to bypass at least some current around both the first and second light emitting devices.

21. The solid state lighting apparatus of claim 1, wherein the first configurable shunt is coupled directly to the cathode of the string, and wherein the second configurable shunt is coupled directly to the cathode of the string.

22. The solid state lighting apparatus of claim 1, wherein the first configurable shunt is coupled directly to the anode of the string, and wherein the second configurable shunt is coupled directly to the anode of the string.

23. The solid state lighting apparatus of claim 1, wherein the second configurable shunt is configured to bypass at least some current around the first light emitting device and the second light emitting device without the first configurable shunt.

24. A solid state apparatus comprising:

a circuit including respective groups of series-connected solid state light emitting devices connected in series in a string between an anode terminal of the string and a cathode terminal of the string, wherein a first group of the string is coupled directly to the cathode terminal of the string and includes a first number of solid state light emitting devices, and wherein a second group of the string is not coupled directly to the cathode terminal of the string and includes a second number of solid state light emitting devices not equal to the first number, and wherein a third group of the string is coupled directly to the second group and includes a third number of solid state light emitting devices not equal to the first or second numbers, and wherein a fourth group of the string is coupled directly to the third group and includes a fourth number of solid state light emitting devices not equal to the first, second or third numbers, and wherein the first, second, third and fourth numbers are configured to vary a total number of light emitting devices of the string that may receive current and comprise one, two, three and four;

a first configurable shunt directly coupled between a terminal of the first group and at least one of the cathode or anode terminal of the string and configured to bypass at least some current around the first group;

a second configurable shunt directly coupled between a terminal of the second group and a same end terminal of the string as the first configurable shunt and configured to bypass at least some current around the first group and the second group;

a third configurable shunt coupled between a terminal of the third group and the same terminal of the string as the first and second configurable shunts and configured to bypass at least some current around the first, second and third groups;

a fourth configurable shunt coupled between a terminal of the fourth group and the same terminal of the string as the first, second and third configurable shunts and configured to bypass at least some current around the first, second, third and fourth groups; and a thermistor, tunable resistor and/or variable resistor coupled in parallel with the first and second configurable shunts, wherein the thermistor, tunable resistor and/or variable resistor is different than the first and second configurable shunts.

25. The method of claim 17, wherein one of the at least two configurable shunts electrically bypasses at least two of the solid state light emitting devices when a voltage is applied across the anode and cathode terminals of the first string.

26. The solid state lighting apparatus of claim 1, further comprising:

a thermistor coupled in parallel with the first and second configurable shunts and coupled directly to the anode terminal of the string, wherein the same end terminal of the string is the cathode terminal of the string, and wherein thermistor is different than the first and second configurable shunts.

27. The solid state lighting apparatus of claim 1, wherein the circuit is configured to control the first configurable shunt, the second configurable shunt and the thermistor, tunable resistor and/or variable resistor coupled in parallel with the first and second configurable shunts to maintain an intensity and correlated color temperature (CCT) of a combined emitted white light, wherein the combined emitted white light has a CCT between 3000° and 3500° K.

28. A solid state lighting apparatus comprising:

a circuit comprising a plurality of light emitting devices wherein the solid state light emitting devices are connected in parallel at an anode terminal and a cathode terminal of the circuit, wherein the anode terminals of the solid state light emitting devices are directly connected to the anode terminal of the circuit and the cathode terminals of the solid state light emitting devices are directly connected to the cathode terminal of the circuit;

a first configurable shunt connected in parallel to the plurality of light emitting devices, wherein a first terminal of the first configurable shunt is directly connected to the anode terminal of the circuit and a second terminal of the first configurable shunt is directly connected to the cathode terminal of the circuit, and wherein the first configurable shunt is configured to bypass at least some current around the plurality of light emitting devices.

* * * * *

UNITED STATES PATENT AND TRADEMARK OFFICE

CERTIFICATE OF CORRECTION

PATENT NO. : 8,901,829 B2
APPLICATION NO. : 12/566142
DATED : December 2, 2014
INVENTOR(S) : van de Ven et al.

It is certified that error appears in the above-identified patent and that said Letters Patent is hereby corrected as shown below:

In the Claims:

Column 10, Claim 1, Line 61: Please correct "at least sonic current"
to read -- at least some current --

Column 12, Claim 15, Line 14: Please correct "second sting"
to read -- second string --

Column 13, Claim 24, Line 8: Please correct "state apparatus"
to read -- state lighting apparatus --

Signed and Sealed this
Twelfth Day of May, 2015

Michelle K. Lee

Michelle K. Lee
*Director of the United States Patent and Trademark Office*